US009556660B2

(12) United States Patent
Svara et al.

(10) Patent No.: US 9,556,660 B2
(45) Date of Patent: Jan. 31, 2017

(54) DAMPED HINGE ASSEMBLIES

(71) Applicant: Lama D. D. Dekani, Dekani (SI)

(72) Inventors: Valter Svara, Izola (SI); Danijel Kozlovic, Dekani (SI); David Pecar, Pobegi (SI)

(73) Assignee: LAMA D. D. DEKANI, Dekani (SI)

( * ) Notice: Subject to any disclaimer, the term of this patent is extended or adjusted under 35 U.S.C. 154(b) by 0 days.

(21) Appl. No.: 14/769,608

(22) PCT Filed: Feb. 13, 2014

(86) PCT No.: PCT/EP2014/052850

§ 371 (c)(1),
(2) Date: Aug. 21, 2015

(87) PCT Pub. No.: WO2014/128050

PCT Pub. Date: Aug. 28, 2014

(65) Prior Publication Data

US 2016/0010380 A1 Jan. 14, 2016

(30) Foreign Application Priority Data

Feb. 21, 2013 (GB) ..... 1303093.7

(51) Int. Cl.

| | |
|---|---|
| ***E05F 5/00*** | (2006.01) |
| ***E05F 5/10*** | (2006.01) |
| ***E05D 3/14*** | (2006.01) |
| ***E05F 5/06*** | (2006.01) |

(52) U.S. Cl.

CPC ..... *E05F 5/006* (2013.01); *E05D 3/14* (2013.01); *E05D 3/142* (2013.01); *E05F 5/06* (2013.01); *E05F 5/10* (2013.01); *E05Y 2201/624* (2013.01); *E05Y 2600/53* (2013.01); *E05Y 2900/20* (2013.01); *Y10T 16/54* (2015.01)

(58) Field of Classification Search

CPC ..... E05D 3/142; E05D 3/14; E05F 5/006; E05F 5/02; E05F 5/06; E05F 5/10; E05F 3/20; Y10T 16/54; Y10T 16/544; Y10T 16/5406

See application file for complete search history.

(56) References Cited

U.S. PATENT DOCUMENTS 3,893,209 A * 7/1975 Sewing ..... E05D 11/1021 16/323
5,269,043 A * 12/1993 Yang ..... E05F 5/006 16/68
5,524,323 A * 6/1996 Lin ..... E05D 5/08 16/235

(Continued)

FOREIGN PATENT DOCUMENTS

WO WO2006053354 A1 5/2006

*Primary Examiner* — Jeffrey O Brien
(74) *Attorney, Agent, or Firm* — Alan D. Kamrath; Kamrath IP Lawfirm, P.A.

(57) ABSTRACT

A damped hinge assembly is provided that comprises a hinge unit (10) and a damping unit (14). A mechanism is provided for connecting the two units together for purposes of transportation and handling, as well as for ease of installation. The connecting mechanism allows the units to move relative to one another between a transit state, which allows access for installation purposes, and a working position in which the damping unit is operative to provide resistance to closing movement of a door.

15 Claims, 4 Drawing Sheets

(56) References Cited

U.S. PATENT DOCUMENTS

| | | | | |
|---|---|---|---|---|
| 7,065,833 | B2 * | 6/2006 | Kropf | E05D 3/142 16/286 |
| 7,395,580 | B2 * | 7/2008 | Brustle | E05F 5/006 16/50 |
| 8,186,014 | B2 * | 5/2012 | Pecar | E05D 3/142 16/286 |
| 8,387,213 | B2 * | 3/2013 | Brunnmayr | E05F 5/006 16/319 |
| 8,640,305 | B2 * | 2/2014 | Pecar | E05F 5/006 16/286 |
| 8,857,014 | B2 * | 10/2014 | Brunnmayr | E05F 5/006 16/319 |
| 8,925,151 | B2 * | 1/2015 | Salice | E05F 5/006 16/286 |
| 9,003,605 | B2 * | 4/2015 | Pecar | E05F 5/006 16/286 |
| 9,057,214 | B2 * | 6/2015 | Salice | E05F 5/006 |
| 2007/0157429 | A1 * | 7/2007 | Gallasch | E05F 5/006 16/238 |
| 2009/0119876 | A1 * | 5/2009 | Pecar | E05D 3/142 16/293 |
| 2010/0139041 | A1 * | 6/2010 | Pecar | E05F 5/006 16/273 |
| 2014/0352111 | A1 * | 12/2014 | Ng | E05F 5/02 16/286 |
| 2015/0292252 | A1 * | 10/2015 | Svara | E05F 5/006 16/341 |
| 2015/0361699 | A1 * | 12/2015 | Manzoni | E05D 3/142 16/251 |
| 2016/0032636 | A1 * | 2/2016 | Dai | E05F 5/006 16/65 |
| 2016/0138319 | A1 * | 5/2016 | Wu | E05F 3/20 16/50 |

* cited by examiner

DAMPED HINGE ASSEMBLIES

This invention relates to damped hinge assemblies, and more particularly, to assemblies that comprise a toggle type hinge, of the sort that is typically used on kitchen cupboards, together with a damping device.

The invention provides a damped hinge assembly comprising a hinge unit and a damping unit, with means for connecting together the two units for transportation and handling, wherein the connecting means permits the units to move relative to one another between a transit state which allows access for securement of the hinge unit to a door or other element and a working position in which the damping unit is operative to provide resistance to movement of said door or other element.

Figure 1A:
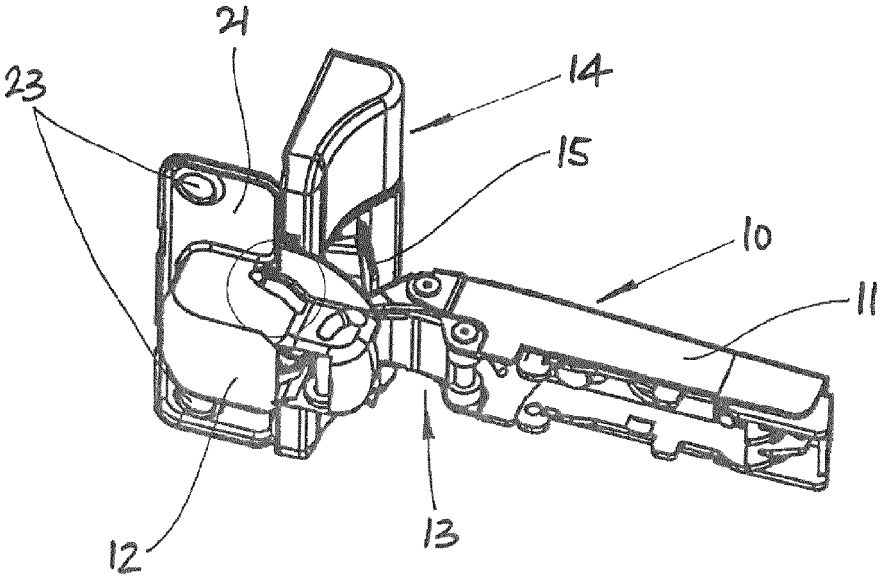
Figure 1B:
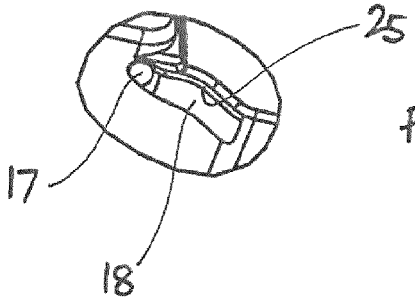
Figure 1C:
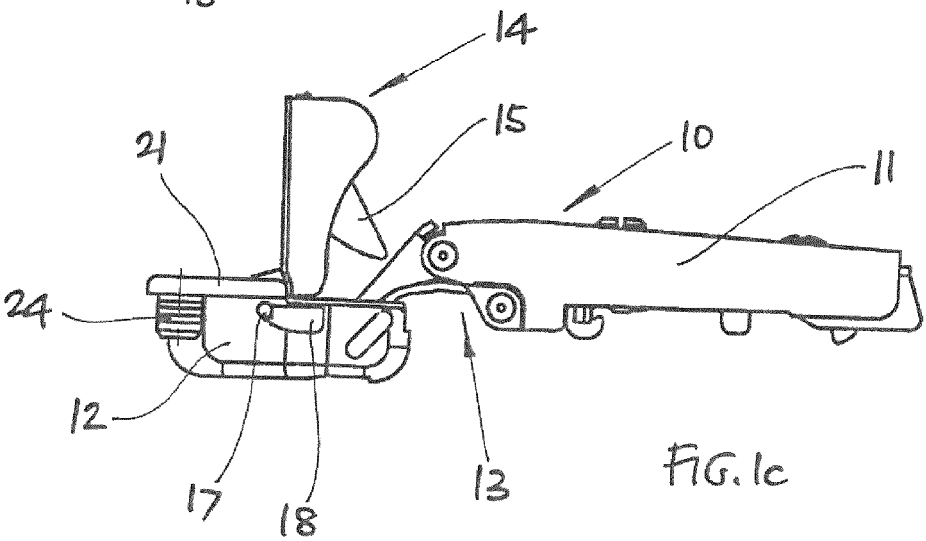
Figure 2A:
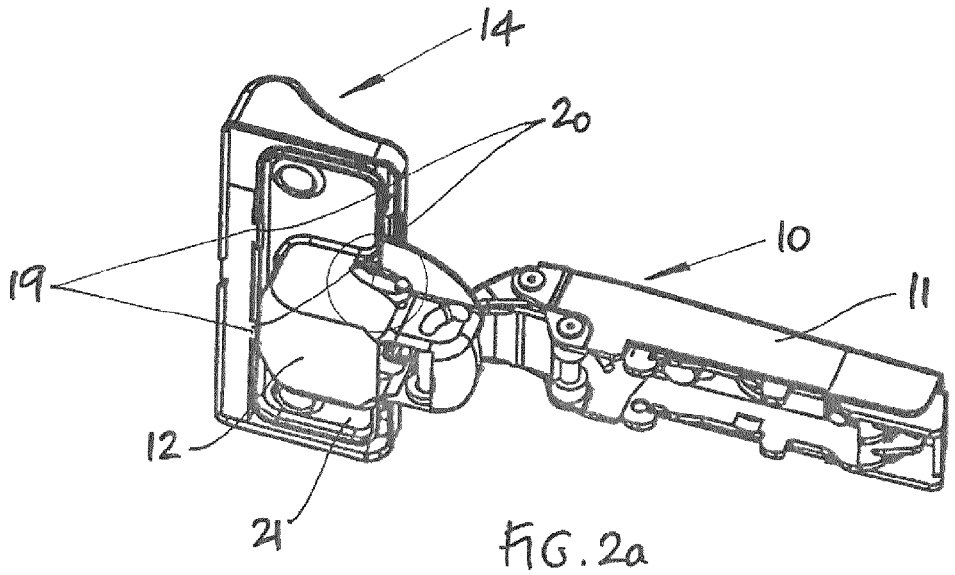
Figure 2B:
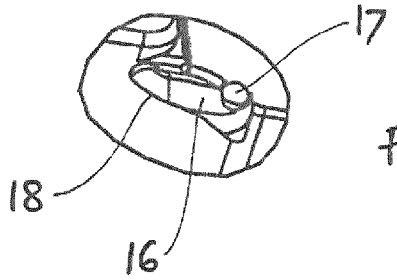
Figure 2C:
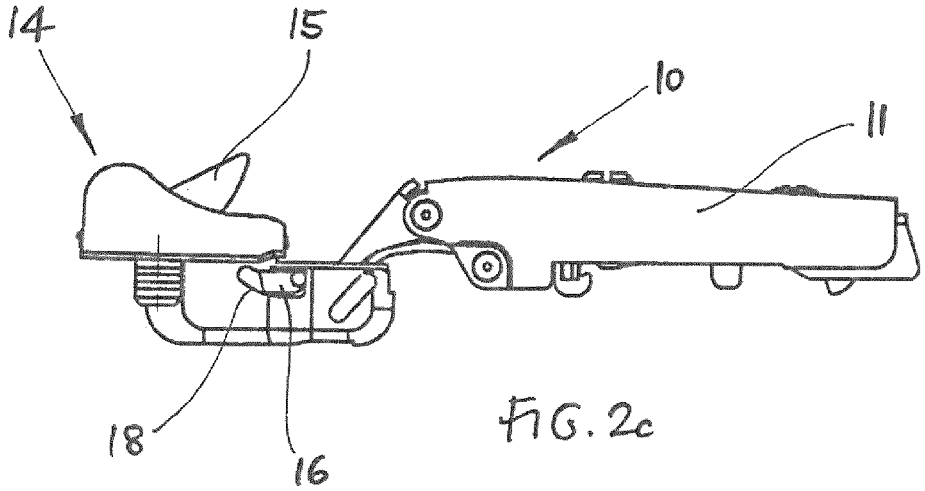
Figure 3:
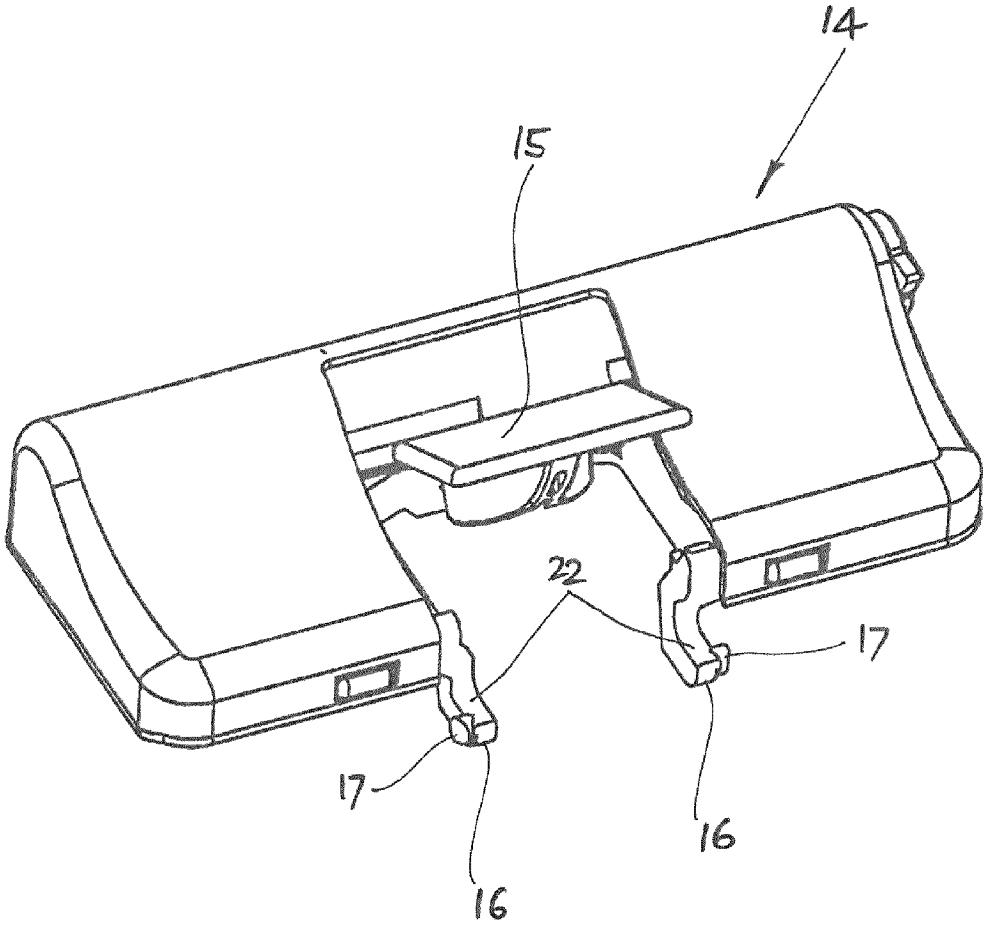
Figure 4:
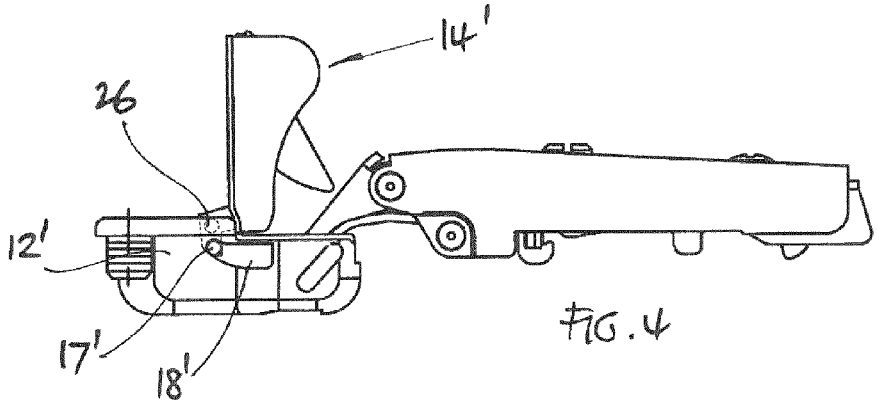
Figure 5:
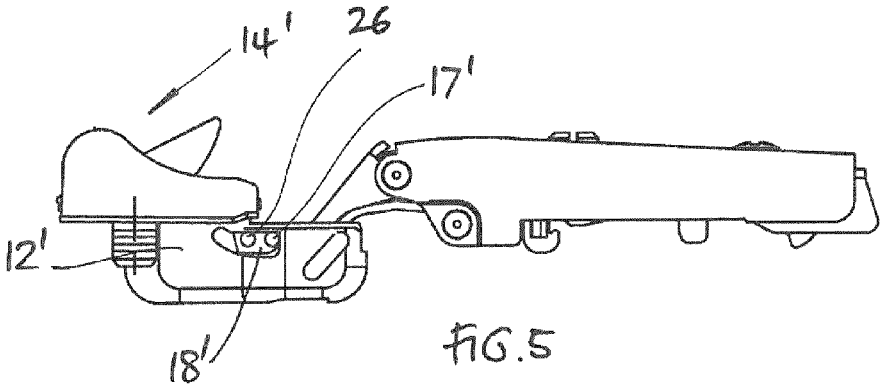
Figure 6:
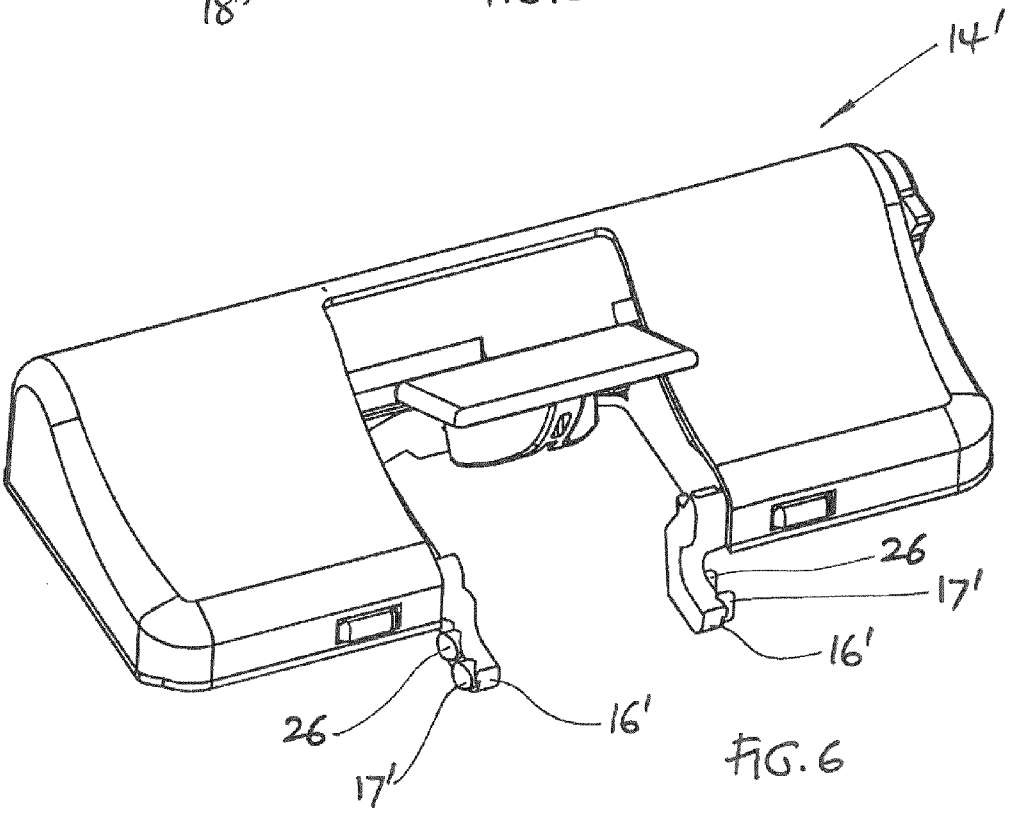

By way of example, embodiments of the invention will now be described with reference to the accompanying drawings, in which:

FIGS. 1*a*, 1*b* and 1*c* show a first form of damped hinge assembly according to the invention in a first state, FIGS. 2*a*, 2*b* and 2*c* show the assembly in a second state, FIG. 3 shows the damping unit of the assembly, FIG. 4 shows a modified form of damped hinge assembly according to the invention in a first state, FIG. 5 shows the modified assembly in a second state, and FIG. 6 shows the damping unit of the modified assembly.

The damped hinge assembly seen in FIGS. 1*a*, 1*b* and 1*c* comprises a hinge unit 10 of the well known toggle-type construction for hanging a door, e.g. on a kitchen cupboard. The hinge unit 10 comprises an arm assembly 11, which is attachable to a door frame in known manner, and a hinge cup 12, which is attachable to a door in known manner. The hinge cup 12 is pivotably connected to the arm assembly 11 in known manner by means of a compound linkage 13.

The assembly includes a damping unit 14, which has a damper arranged so as to provide damped resistance to the closing movement of the door, at least over the final part of its movement, in known manner. The damper is actuated by a wing 15 which extends out of the damping unit 14 and which in use is arranged to come into contact with the hinge arm 11, in known manner.

The hinge and damping units 10, 14 are designed to remain connected together, which is convenient for transportation and handling. In the embodiment shown in the drawings, a pair of spaced apart arms 16 (best seen in FIG. 3) extend out from the damping unit 14 and each arm has a pin 17 extending laterally out therefrom. The pins 17 are designed to be engageable in slots 18 formed on opposite sides of the hinge cup 12. The arms 16 here are provided as part of a die cast component and consequently have enough elasticity to enable the pins 17 to be sprung into position in the slots 18. With the pins 17 thus in position, the hinge and damping units 10, 14 are effectively connected together.

The pins 17 are designed to be in alignment with each other and thus effectively form a rotational axis about which the damping unit 14 is able to pivot relative to the hinge unit 10. The slots 18 are generally elongate in shape and the pins 17 are able to move along them. This means that the rotational axis defined by the pins 17 is able to move with respect to the hinge unit 10. Here, the slots 18 are arranged with their longitudinal axes generally parallel to the flange 21 of the hinge cup 12. This means that the pins 17 are able to move along a path generally parallel to the hinge cup flange 21.

It is necessary to allow for this freedom of both rotational and translational movement of the pins 17 to enable the attachment of the damping unit 14 to the hinge unit 10, because the attachment is effected between the hinge cup 12 on the one hand and the hinge cup flange 21 on the other hand. In particular, this means that there has to be sufficient clearance between the pins 17 and the edge of the damping unit 14 to clear the flange 21 of the hinge cup 12.

It will be understood that the connection mechanism may be realised in different ways to achieve the same effect. For example, the pins 17 could be provided as separate items and attached to the arms 16 after they have been inserted into the slots 18. Also, the pin and slot arrangement could be provided the other way round, ie with the slots on the arms and the pins on the hinge cup.

FIGS. 1*a* and 1*c* show the assembly in a state in which the damping unit 14 lies roughly at rights angles to the hinge cup flange 21. As will be seen, this allows access to the hinge cup flange 21 for the purpose of securing the hinge cup 12 to a door or other element, with screws via holes 23 or by other fasteners such as dowels 24, in known manner. It is convenient for the assembly to be in this state for general handling and transportation, because then it is immediately ready for installation.

The assembly is seen in a different state in FIGS. 2*a* and 2*c*, where the damping unit 14 has been moved to its working position on the hinge unit 10. In this state, the damping unit 14 is fastened down onto the hinge cup flange 21, with the wing 15 extending out into position to engage the hinge arm 11 and hence provide damped resistance to the closing movement of the door. The assembly will be in this state after installation. It will be seen that the damping unit 14 covers the hinge cup 12 in this state to give the assembly a neat finished appearance.

It will be seen that the bottom edges of the slots 18 are slightly curved. The pins 17 will tend to react against these edges when the damping unit 14 is moved from its transit state of FIG. 1*a* to its working position. Having a curved surface will tend to facilitate this movement.

The securement of the damping unit 14 in its working position is achieved partly by engagement of the arms 16 with the hinge cup 12. The arms 16 are designed to extend through the slots 18 in the hinge cup 12 so that the upper surfaces of the arms (indicated by reference numeral 22 in FIG. 3) enagage the upper edges of the slots (indicated by reference numeral 25 in FIG. 1*b*). Along its edge opposite the arms 16, the damping unit 14 has a pair of catches 19. These catches 19 are designed to engage with recesses 20 formed along the edge of the flange 21 of the hinge cup 12 (best seen in FIG. 2*a*). The catches 19 are designed to have sufficient elasticity to enable them to be pressed by hand into engagement with their respective recesses 20 with a snap-fitting. The damping unit 14 is thus held down onto the hinge cup 12 by the engagement of the catches 19 in the recesses 20 on the one hand, and by the engagement described above of the arms 16 in the slots 18 on the other hand.

It will be noted that the manner of securement of the damping unit 14 in its working position is designed to be capable of withstanding the forces that can be expected to be imposed upon the assembly by the closing movement of the door. These forces will be transmitted to the assembly via the wing 15, which will impart a moment on the damping unit 14 tending to dislodge it from the cup 12. The positive engagement of the arms 16 in the slots 18 is apt to resist this.

A modified form of hinge assembly is seen in FIGS. 4, 5 and 6. This assembly has special provision for temporarily holding it in its transit state. This takes the form of a pair of additional pins 26 on the damping unit 14'. The additional pins 26 are situated on the arms 16' adjacent to the pins 17' and extending from the arm 16' in the same way as the pins 17'. The arms 16' here are designed to be capable of resilient flexure.

FIG. 4 shows the assembly in its transit state. In this state, the additional pins 26 lie outside the slots 18', whereas the pins 17' are engaged within the slots 18'. This means that the additional pins 26 are in contact with the inner surface of the hinge cup 12'. This provides an interference fit so that, by resilient flexure of the arms 16', the additional pins 26 are effectively held under compression. The compressive and frictional forces thereby generated are designed to be sufficient to ensure that the assembly will be held in its transit state during normal handling and transportation.

The damping unit 14' is movable into its working position in the same manner as the previously described assemblies, although in this case a slightly greater force will be needed to overcome the compressive and frictional forces on the additional pins 26 that initially hold the assembly in its transit state. As the damping unit 14' is moved into its working position, it will be seen that the additional pins 26 spring out of contact with the hinge cup 12' and into the slots 18', together with pins 17' (see FIG. 5).

It will be understood that the mechanism for temporarily holding the assembly in its transit state could take many different forms.

The invention claimed is:

1. A damped hinge assembly comprising a hinge unit; a damping unit; and means for connecting together the hinge and damping units for transportation and handling, wherein the connecting means permits the hinge and damping units to rotate relative to one another between a transit state which allows access for securement of the hinge unit to a door or other element and a working position in which the damping unit is operative to provide resistance to movement of said door or other element, wherein the connecting means comprises elongate holes in one of the hinge and damping units and a pair of pins on another one of the hinge and damping units respectively engaging with the holes, wherein the hinge unit comprises a hinge cup with a flange, and wherein one of the pair of pins and the holes of the connecting means are provided in the hinge cup.

2. An assembly as claimed in claim 1 wherein the pair of pins define a rotational axis about which to allow relative pivotal movement between the hinge and damping units.

3. An assembly as claimed in claim 2 wherein the rotational axis is movable along a path with respect to the hinge cup.

4. An assembly as claimed in claim 3 wherein the hinge cup the elongate holes for guiding the movement of the rotational axis along a curved path.

5. An assembly as claimed in claim 4 wherein the damper unit comprises a pair of arms which form part of said means for connecting the units together and which also serve in securing the damper unit to the hinge unit.

6. An assembly as claimed in claim 5 wherein the pair of pins is provided on the pair of arms, which extend from the damping unit.

7. An assembly as claimed in claim 6 wherein the pair of arms is resiliently flexible.

8. An assembly as claimed in claim 5 wherein the elongate holes have curved edges which define said curved path for guiding movement of the rotational axis.

9. An assembly as claimed in claim 5 wherein the holes have edges that act as reaction surfaces for engagement by the pair of arms.

10. An assembly as claimed in claim 5 wherein the pair of pins is engagable in the holes by an elastic snap-fitting.

11. An assembly as claimed in claim 1 wherein the damping unit is securable to the hinge unit by engagement with both a side of the hinge cup and the flange of the hinge cup.

12. An assembly as claimed in claim 11 wherein the damping unit is securable to the hinge unit in the working position by an elastic snap-fitting.

13. An assembly as claimed in claim 1 further comprising means for temporarily holding the hinge and damping units together in the transit state for handling and transportation.

14. An assembly as claimed in claim 13 wherein the temporarily holding means uses compressive and/or frictional force.

15. A piece of furniture incorporating a damped hinge assembly as claimed in claim 1.

* * * * *